US005794778A

United States Patent [19]

Harris

[11] Patent Number: 5,794,778

[45] Date of Patent: Aug. 18, 1998

[54] ARTICLE CARRIER WITH STRAP-TYPE HANDLE AND TOP PANEL ACCESS

[75] Inventor: Randall L. Harris, Power Springs, Ga.

[73] Assignee: Riverwood International Corporation, Atlanta, Ga.

[21] Appl. No.: 806,821

[22] Filed: Feb. 26, 1997

[51] Int. Cl.[6] ..... B65D 71/28

[52] U.S. Cl. ..... 206/428; 206/806

[58] Field of Search ..... 206/427, 428, 206/434, 162, 170, 806; 229/87.04, 87.05, 89; 294/137, 159

[56] References Cited

U.S. PATENT DOCUMENTS 4,582,199 4/1986 Schuster ..... 206/428

5,593,027 1/1997 Sutherland ..... 206/428 X 5,595,292 1/1997 Bates ..... 206/428 X

*Primary Examiner*—Jacob K. Ackun

[57] ABSTRACT

An article carrier having an elongated handle strap and a tear-away top opening feature. The handle strap may extend between either the end panels or the side panels of the carrier and is separably connected to the top panel. The separable lines of weakness extend into the end or side panels and, with other lines of weakness, allow portions of the end or side panels to be separated. This allows the top panel portions on either side of the handle strap to be folded back to allow access to the packaged articles. Even after the top panel portions are separated the carrier can be lifted by the handle.

18 Claims, 3 Drawing Sheets

ARTICLE CARRIER WITH STRAP-TYPE HANDLE AND TOP PANEL ACCESS

FIELD OF THE INVENTION

This invention relates to article carriers which incorporate integrally formed handles. More particularly, it relates to a carrier of this type which provides access to the packaged articles through the top panel of the carrier.

BACKGROUND OF THE INVENTION

Article carriers are normally provided with a handle for convenient lifting. Although it may take many forms depending on the type of carrier involved, a satisfactory handle should be designed so as to be readily grasped, comfortable to the hand and capable of lifting the carrier without tearing. In the case of sleeve-type carriers, an elongated strap extending between opposite side or end panels has been found to be quite comfortable to grip and has the advantage of distributing lifting stresses to the sides or ends of the carrier where they are more readily disseminated with less risk of tearing the carrier.

When packaging certain articles, such as beverage containers, it is often desirable to provide access to the interior of an enclosed carrier by means of tear-away sections. Once the sections are torn away and the containers removed the carrier normally is no longer in condition to be used. If it is desired to return the used containers to a retail outlet or to transport the remaining containers after only a few have been removed from the package, it would be convenient to be able to again carry them in the original carrier. To do this, the carrier must not be destroyed the tear-away sections are removed and should still be capable of being lifted by the handle.

Another drawback of the typical tear-away design in enclosed carriers is that the articles must be removed through the sides or ends of the carrier. It is normally not possible to remove some of the articles through the sides or ends and still use the carrier to transport the remaining articles. While it would be preferable to selectively remove articles through the top of the carrier, such an arrangement is not compatible with known strap-type handle designs.

It would be highly desirable to be able to provide a carrier having an integral handle which extends from one end of the carrier to the other, or from one side to the other, while at the same time providing access to the interior of the carrier through tear-away sections in the top panel. It is the primary object of the invention to provide a carrier which meets these objectives.

BRIEF SUMMARY OF THE INVENTION

The invention is incorporated in a carrier in which a handle strap is separably connected to the top panel by lines of weakness, the handle strap extending between either the opposite end panels or the opposite side panels and dividing the top panel into two portions. The lines of weakness of the handle continue into either the opposite end panels or the opposite side panels and additional lines of weakness extend from the continued lines of weakness substantially toward the upper corners of the carrier. Severing of the lines of weakness of the handle occurs when lifting the carrier. Subsequent severing of the lines of weakness in the end or side panels allows the top panel portions to be folded back to permit access to the interior of the carrier.

In a preferred arrangement fold lines in the end or side panels form tabs with the lines of weakness in those panels, which may be conveniently gripped when severing the lines of weakness in the end or side panels. If it is desirable to make the handle more tear resistant, a flexible reinforcing strip, such as strands of reinforcing material, may be adhered to the handle strap.

The invention not only permits the carrier to be lifted by a comfortable, strong strap-type handle, but also provides access to the interior of the carrier without destroying the ability of the carrier to continue to support the packaged articles when lifted by the handle.

The features of the invention which enable it to provide the desired results are brought out in more detail in the description of the preferred embodiments, wherein the above and other aspects of the invention, as well as other benefits, will readily become apparent.

DETAILED DESCRIPTION OF THE PREFERRED EMBODIMENTS

Figure 1:
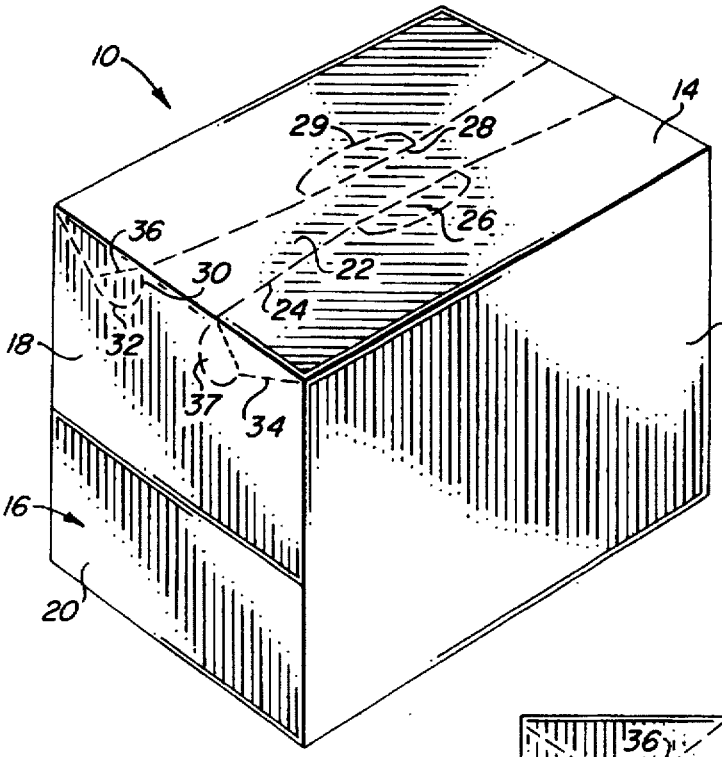
FIG. 1 is a pictorial view of a sleeve-type carrier in which a handle strap extends between opposite end panels.

Referring to FIG. 1, a carrier 10 is comprised of side panels 12 connected to top panel 14 and to a bottom panel which is hidden in this view. The carrier also includes end panels 16 formed of end panel flaps connected to the top, side and bottom panels. The major end panel flaps 18 and 20, which are connected to the top and bottom panels, respectively, are visible in this view. Included in the top panel is handle strap 22 which is connected along its length to the top panel by readily separated lines of weakness 24. The lines of weakness may be of any desired design. Preferably, however, they are comprised of slits separated by short connecting portions of the top panel which are readily severed or torn when the handle is used to lift the carrier. The handle includes centrally located handle grip flaps 26 which are connected to the strap by fold lines 28 and to the top panel by readily separated lines of weakness 29.

Figure 2:
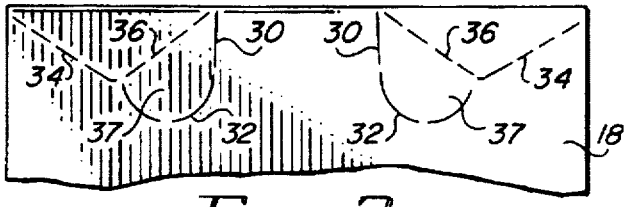
FIG. 2 is an enlarged partial end view of the carrier of FIG. 1.

As shown in FIGS. 1 and 2, the lines of weakness 24 extend into the end panels for a short distance, as indicated by reference numeral 30, and continue in outwardly extending arcuate portions 32. Additional lines of weakness 34 extend from the end of arcuate portions 32 to a point in the vicinity of the nearest upper corner of the carrier. Fold lines 36 extend from the ends of the arcuate lines of weakness 32 to the top panel at the intersection of the lines of weakness 24 and 30. The areas bounded by the fold lines 36 and the lines of weakness 30 and 32 define tabs 37 used in opening the top panel, as described further below.

Figure 3:
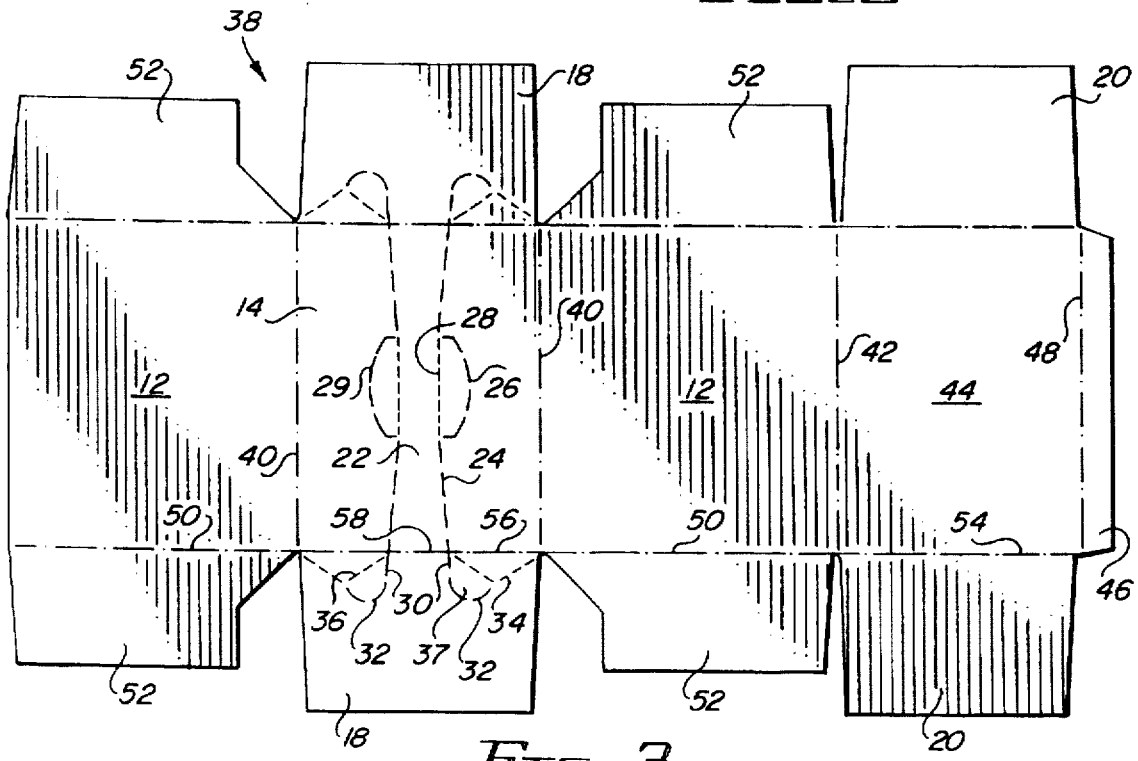
FIG. 3 is a plan view of a blank for forming the carrier of FIG. 1.

Referring now to FIG. 3, a generally rectangular blank 38 from which the carrier is formed is comprised of top panel section 14 connected by opposite fold lines 40 to side panel sections 12. The side panel section in the interior of the blank is connected by fold line 42 to bottom panel section 44, and glue flap 46 is connected to the bottom panel section 44 by fold line 48. Fold lines 50 connect both of the side panel sections 12 to minor end panel flaps 52, while fold lines 54 connect the bottom panel section 44 to the lower major end panel flaps 20. The upper major end panel flaps 18 are connected to the top panel section 14 by fold lines 56, which are aligned with the fold lines 50 and 54 and which extend through the handle strap 22 as fold line 58. The relationship of the lines of weakness 24 in the top panel section and the lines of weakness 30, 32 and 34 in the end panel flaps 18 can be seen to be as described in connection with the carrier of FIG. 1.

To form a carrier from the blank the bottom panel section 44 is folded about fold line 42 onto the adjacent side section 12, after which the side panel section 12 at the end of the blank is folded about fold line 40 and glued to the glue flap 46. This produces a flat tube or collapsed carrier which typically is shipped to a packaging facility where it is erected, loaded with the articles being packaged and its ends closed by means well known in the industry to form the finished carrier of FIG. 1.

Figure 4:
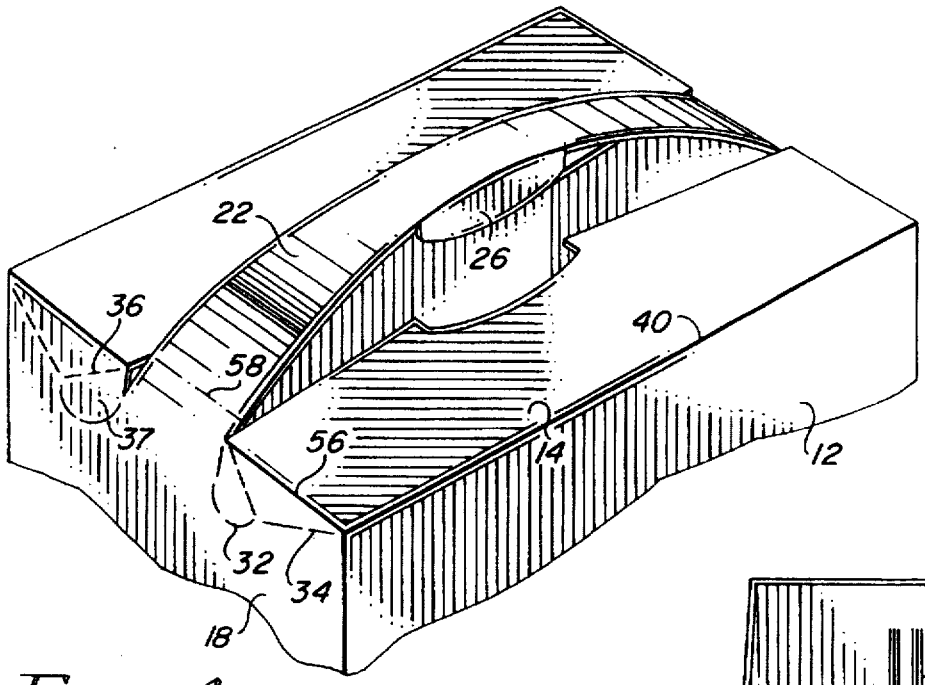
FIG. 4 is a partial pictorial view of the carrier, with the packaged contents omitted, showing the handle in operative condition.

To utilize the handle, a user simply presses down on the handle grip flaps 26, severing the lines of weakness 29 attaching them to the top panel, and folding the flaps down about the fold lines 28. The handle strap can then be fully grasped and the carrier lifted by the handle. When the carrier is lifted the weight of the carrier causes the handle to separate from the top panel along the lines of weakness 24 and to bow upwardly, as illustrated in FIG. 4. As also illustrated, this bowing action causes the portions of the handle strap in the end panels and in the adjacent portions of the top panel to be pulled inwardly away from the end panels of the carrier, resulting in the handle strap separating from the end panels for a short distance along the lines of weakness 30. The arcuate lines of weakness 32 act as stress relief cuts, preventing tearing of the end panels during lifting.

To gain access to the packaged articles after lifting the carrier has separated the lines of weakness 24, a user simply grasps the exposed portion of the tear-away tabs 37 at opposite ends of the carrier and pulls the remaining tear-away sections from the end panels along lines of weakness 32 and 34. If the tabs are not exposed enough to be easily grasped, they can first be separated from the end panels along the lines of weakness 32 by pushing them in toward the interior of the carrier. These maneuvers are facilitated by the fold lines 36, which allow the tabs 37 to be folded out so as to be more readily gripped during the tear-away process. As mentioned above, the lines of weakness 34 terminate in the vicinity of the upper corners of the carrier. This is illustrated in the drawings wherein the lines of weakness 34 terminate short of the side edges of the end panel flap 18 and slightly below the top panel. This short unweakened portion of the end panel flap is readily torn when opening a package but prevents unintentional tearing of the line of weakness 34, which would be a risk if the line of weakness were to extend out to the side edge of the end panel flap 18.

Figure 5:
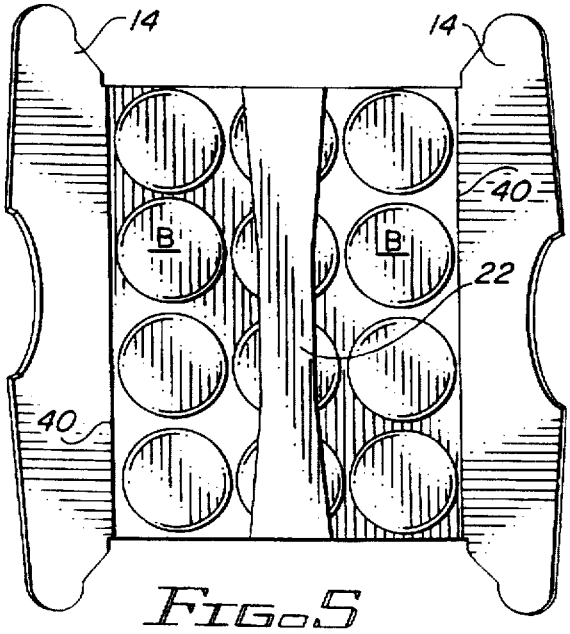
FIG. 5 is a top view of an opened carrier after the tear-away sections have been separated and the top panel portions folded back.

Since the separation of the handle from the top panel and the separation of the tear-away sections from the end panels leave the top panel portions on either side of the handle connected only at the fold lines 40, the interior of the carrier can be exposed simply by folding the top panel portions back along the fold lines 40. The carrier in this condition is illustrated in FIG. 5, which reveals the packaged bottles B. Of course, if desired, only one of the top panel portions need be separated and folded back if access is needed to only some of the bottles. Note that in any case the carrier is still in condition to be lifted and carried by the handle, regardless of whether one or both of the top panel portions have been separated and folded back. This is possible due to the handle strap 22 being permanently attached to the end panels only, not to the top panel.

Figure 6:
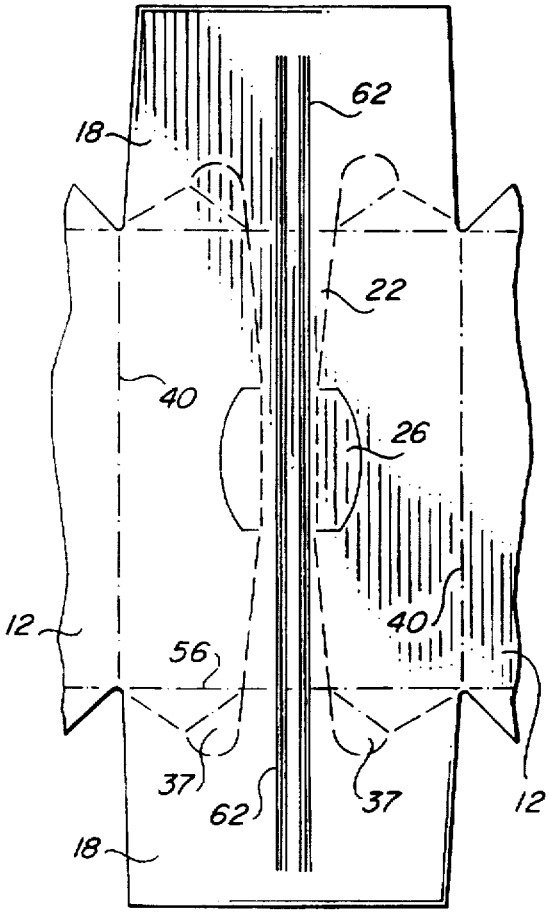
FIG. 6 is a partial plan view of a modified blank for forming a carrier with a reinforced handle.

If the carrier is designed to carry heavy articles or large numbers of articles, it may be desirable to further strengthen the handle against tearing. One way of accomplishing this is illustrated in FIG. 6, which shows reinforcing strands 62 adhered to the inner surfaces of the handle 22 and the end panel flaps 18. The strands may be comprised of any suitable material possessing adequate flexibility and tensile strength, such as, for example, fiber glass strands. The flexibility of the strands allows them to follow the bowing of the handle when the carrier is lifted while remaining adhered to both the handle and the end panels. Reinforcement is not limited to material in the form of strands. Reinforcing material in the form of tape or other suitable elongated form which also possesses the qualities of flexibility and tensile strength could be used as well.

Figure 7:
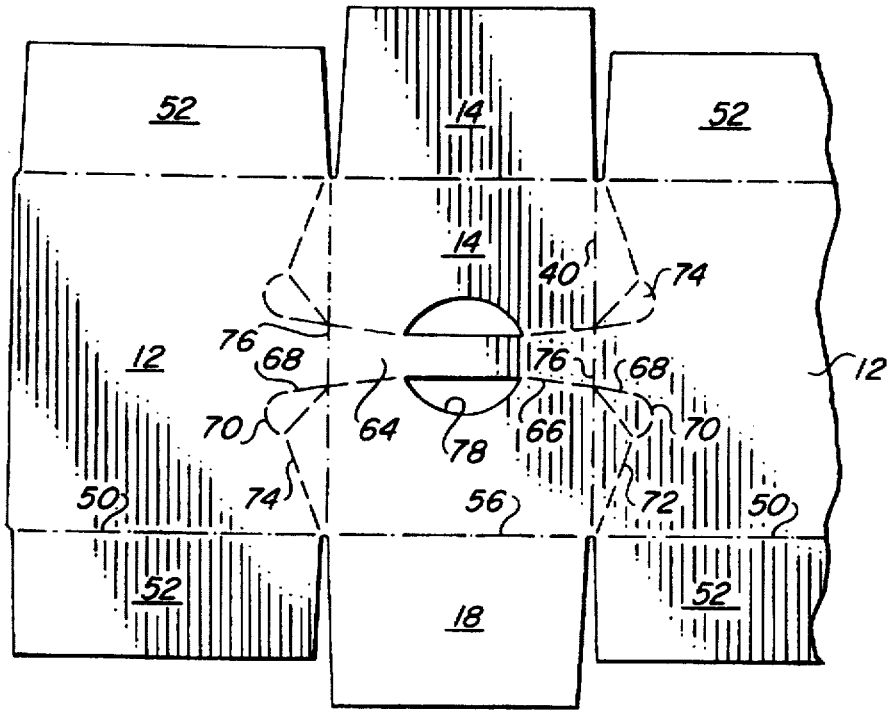
FIG. 7 is a partial plan view of a blank for forming a carrier in which the handle strap extends between opposite side panels.

The invention is not limited to use of a handle strap which extends along the length of the carrier. A strap extending along the width of the carrier may be employed as well. A blank for forming such a carrier is illustrated in FIG. 7, wherein a handle strap 64 is connected to the top panel 14 by lines of weakness 66. Lines of weakness 68, 70 and 72 in the side panels 12 correspond to the lines of weakness 30, 32 and 34 in the end panels of the first embodiment, differing primarily only in the different lengths of the lines of weakness 34 and 72. As in the first embodiment, the lines of weakness form tabs 74. The handle 64 is connected to the side panels 12 by fold lines 76, which are coincident with the fold lines 40, and a handle cutout 78 in the top panel section 14 provides room for the hand of a user to grip the handle. The portions of the blank omitted from FIG. 7 are similar to the corresponding portions of the blank of FIG. 3.

Figure 8:
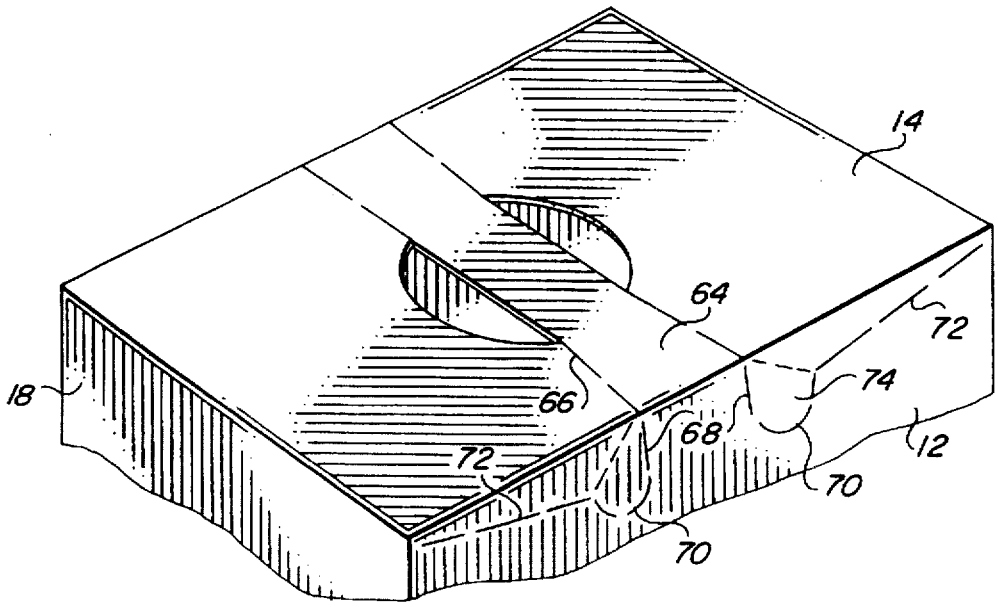
FIG. 8 is a partial pictorial view of a sleeve-type carrier, with the packaged contents omitted, formed from the blank of FIG. 7.

FIG. 8 shows the upper portion of a carrier produced from the blank of FIG. 7. It can be seen that the primary difference from the carrier of FIG. 1 is the different orientation of the handle, requiring the tear-away sections to be located in the side panels instead of the end panels.

It should now be appreciated that the invention provides a strong handle which extends from one end of the carrier to the other, thus distributing lifting stresses to the relatively strong side or end panels rather than to the top panel. In addition, the interior of the carrier can be accessed through the top of the carrier without weakening the handle structure, thereby permitting the carrier and its contents to be lifted by the handle even after the top panel has been opened.

The invention is not intended to be limited to the specific carrier design described, but may be incorporated in other carrier designs in which the top panel is formed from connected top panel flaps. Because the invention is not necessarily limited to all the specific details described in connection with the preferred embodiments, except as they may be within the scope of the appended claims, changes to certain features of the preferred embodiments which do not alter the overall basic function and concept of the invention are contemplated.

What is claimed is:

1. An article carrier, comprising:

top and bottom panels, opposite side panels and opposite end panels;

the top panel being connected by fold lines to the opposite side panels and the opposite end panels, the top panel and the side and end panels meeting at four upper corners;

the top panel including a handle strap separably connected thereto by lines of weakness, the handle strap extending between either the opposite end panels or the opposite side panels and dividing the top panel into two portions;

the lines of weakness of the handle continuing into either the opposite end panels or the opposite side panels; and additional lines of weakness extending from the continued lines of weakness substantially toward the upper corners;

whereby severing of the lines of weakness of the handle, the continued lines of weakness and the additional lines of weakness allow the top panel portions to be folded back to provide access to the interior of the carrier.

2. An article carrier as defined in claim 1, wherein the handle strap is connected to either the fold lines connecting the top panel to the end panels or the fold lines connecting the top panel to the side panels.

3. An article carrier as defined in claim 2, wherein each continuing line of weakness includes an arcuate portion.

4. An article carrier as defined in claim 3, including additional fold lines extending substantially between portions of the continuing lines of weakness, the additional fold lines and the continuing lines of weakness forming tabs for use in separating the lines of weakness in the end panels or the side panels.

5. An article carrier as defined in claim 1, wherein the additional lines of weakness terminate at a point spaced from the upper corners of the carrier.

6. An article carrier as defined in claim 1, wherein the handle strap extends between the opposite end panels.

7. An article carrier as defined in claim 6, wherein the end panels are comprised of adhered flaps connected to the top, bottom and side panels, the continuing and additional lines of weakness being in the end panel flaps connected to the top panel.

8. An article carrier as defined in claim 1, wherein the handle strap extends between the opposite side panels.

9. An article carrier as defined in claim 1, wherein the handle strap includes a flexible reinforcing strip adhered thereto.

10. An article carrier as defined in claim 9, wherein the reinforcing strip is comprised of strands of reinforcing material.

11. A blank for forming an article carrier, comprising:

two spaced side panel sections, a top panel section and a bottom panel section, the panel sections having side edges and end edges;

the side and end edges of the top panel section substantially meeting at corners of the top panel section;

one of the top and bottom panel sections being located between the side panel sections, the side edges of said one top or bottom panel section being connected to adjacent side edges of the side panel sections by fold lines;

a side edge of the other of the top and bottom panel sections being connected to the side edge of one of the side panel sections by a fold line;

end panel flaps connected by fold lines to the end edges of the top, bottom and side panel sections;

the top panel section including a handle strap separably connected thereto by lines of weakness, the handle strap extending between either the end edges or the side edges of the top panel section;

either the side panel sections or the end panel flaps connected to the top panel section including lines of weakness which in a carrier formed from the blank are continuations of the lines of weakness in the top panel; and additional lines of weakness extending from the continuing lines of weakness substantially toward the corners of the top panel of a carrier formed from the blank;

whereby severing of the lines of weakness of the handle, the continuing lines of weakness and the additional lines of weakness allow the top panel portions of such a carrier to be folded back to provide access to the interior of the carrier.

12. A carrier blank as defined in claim 11, wherein each continuing line of weakness includes an arcuate portion.

13. A carrier blank as defined in claim 12, including fold lines connecting spaced points on the continuing lines of weakness, said connecting fold lines and an associated continuing line of weakness defining a tab.

14. A carrier blank as defined in claim 13, wherein the additional lines of weakness terminate at a point spaced from the corners of the top panel of a carrier formed from the blank.

15. A carrier blank as defined in claim 11, wherein the handle strap extends between the opposite end edges of the top panel section.

16. A carrier blank as defined in claim 11, wherein the handle strap extends between the opposite side edges of the top panel section.

17. A carrier blank as defined in claim 11, wherein the handle strap includes a flexible reinforcing strip adhered thereto.

18. A carrier blank as defined in claim 17, wherein the reinforcing strip is comprised of strands of reinforcing material.

* * * * *